United States Patent [19]

Kotski et al.

[11] 4,260,213

[45] Apr. 7, 1981

[54] ELECTRIC CIRCUIT INTERRUPTER HAVING MEANS FOR RESTRICTING FLOW OR ARC-GENERATED GASES THEREFROM

[75] Inventors: Edward J. Kotski, Lenox; Paul J. Horbal, Adams, both of Mass.

[73] Assignee: General Electric Company, Philadelphia, Pa.

[21] Appl. No.: 514,949

[22] Filed: Oct. 15, 1974

Related U.S. Application Data

[63] Continuation of Ser. No. 387,759, Aug. 13, 1973, which is a continuation of Ser. No. 181,416, Sep. 17, 1971.

[51] Int. Cl.[3] ..... H01R 13/52

[52] U.S. Cl. ..... 339/111; 339/43

[58] Field of Search ..... 339/111, 94 R, 94 C, 339/94 M, 43, 44 M

[56] References Cited

U.S. PATENT DOCUMENTS

| | | | |
|---|---|---|---|
| 2,073,565 | 3/1937 | Ruppel . | |
| 2,752,458 | 6/1956 | Baker et al. | 339/111 |
| 2,809,360 | 10/1957 | Cobbett | 339/111 |
| 2,934,668 | 4/1960 | Dall | 339/94 R |
| 3,374,331 | 3/1968 | Brockhaus et al. | 339/111 X |
| 3,413,592 | 11/1968 | Link | 339/111 |
| 3,476,386 | 10/1969 | Link | 339/111 X |
| 3,509,516 | 4/1970 | Phillips | 339/111 X |
| 3,513,437 | 5/1970 | McMorris | 339/111 |
| 3,533,047 | 10/1970 | McFarlane | 339/94 C |
| 3,542,986 | 11/1970 | Kotski . | |
| 3,668,614 | 6/1972 | Ball | 339/111 |
| 3,713,077 | 1/1973 | Leonard | 339/111 |

FOREIGN PATENT DOCUMENTS

| | | |
|---|---|---|
| 15-142730 | 12/1940 | Japan . |
| 33-19566 | 11/1958 | Japan . |

*Primary Examiner*—Howard N. Goldberg
*Attorney, Agent, or Firm*—William Freedman

[57] ABSTRACT

A high voltage electric cable termination module that is characterized by having a gas-restricting valve mounted on it adjacent one of its ends to impede the flow of hot, ionized arc-generated gases from the module, when an arc is formed by interrupting an electrical circuit within the module. The gas restricting valve is adapted to cooperate with either a movable contact member, or an arc follower, of a second module that is adapted to cooperate with the first module to form a plug-in type connection between a pair of electrical conductors that are housed, respectively, in the two modules. By restricting the flow of ionized gas from the modules, their arc-interrupting capability is enhanced and at the same time the risk of an arc re-strike between the conductors of the separated modules is appreciably reduced.

14 Claims, 4 Drawing Figures

ELECTRIC CIRCUIT INTERRUPTER HAVING MEANS FOR RESTRICTING FLOW OR ARC-GENERATED GASES THEREFROM

CROSS-REFERENCE TO RELATED APPLICATIONS

This is a continuation of application Ser. No. 387,759, filed Aug. 13, 1973, which is a continuation of application Ser. No. 181,416, filed Sept. 17, 1971.

BACKGROUND OF THE INVENTION

The present invention relates generally to electrical conductor termination modules of a type commonly used in high voltage underground electric power distribution systems to connect the cables and operating components of such a system together. More specifically, the invention relates to means for controlling arc-generated gases developed in such modules when a pair of conductors housed therein are separated to create an arc.

In recent years it has become common practice to utilize plug-on type electric cable termination modules in underground power distribution systems in order to provide a convenient means for connecting and disconnecting the various components of the system. While it is generally recognized as being safe practice to de-energize any portion of an underground power distribution system in which a circuit component is to be disconnected from the system, prior to such a disconnection being effected, this practice is not always followed. In fact, due to the difficulty in ascertaining with certainty when such an electric power distribution system is energized, a pair of cable termination modules may be inadvertently disconnected when a system is energized, although the lineman making the disconnection might think the system had been previously de-energized. Also, on relatively low voltage power distribution systems, with modern loadbreak conductor termination modules, it is possible that some experienced lineman may consciously open, or disconnect, an energized circuit, relying on the arc-quenching capability of the load-break termination to extinguish any resulting arc.

Prior to the present invention, it was recognized that ionized gases generated by an arc during the separation of a pair of energized conductors, mounted respectively in a mated pair of conductor termination modules, could cause a possible re-strike of an arc after the initial arc had been extinguished by an arc-snuffing mechanism within the loadbreak modules. Various devices have been developed to deal with such arc-generated gases to reduce the risk of a re-strike arc, or the formation of an arc from one of the energized conductors to ground. One example of such a prior art device is the gas shield and flow directing means disclosed in U.S. Pat. No. 3,587,035—Kotski, entitled "Gas Shield for Load-Break Cable Termination", which issued June 22, 1971 and is assigned to General Electric Company.

The type of gas flow controlling shield disclosed in the above-mentioned Kotski patent has proven to be successful in adequately containing hot ionized gases when used on cable termination modules for electric power distribution systems in the 15 KV range. However, it has been found that on higher voltage power distribution systems, such as those having a rating of 25 KV, it is desirable to provide supplementary means for preventing the escape of most arc-generated gases from loadbreak termination modules during a loadbreak operation. By thus containing the ionized gases within a loadbreak cable termination module, the normal high dielectric strength of air surrounding a pair of separated loadbreak modules is not impaired, so even relatively high line voltages do not usually cause an arc re-strike, or an arc to ground.

One prior art approach to this problem of controlling arc-generated, ionized gases within a loadbreak cable termination module was to provide a gas expansion chamber within the module, into which such gases could be vented during a loadbreak operation. In fact, such auxiliary venting chambers have been provided with pressure responsive valves to further control the flow of gases within the module. An example of such a prior art gas flow control mechanism within an electric power cable termination module is shown in U.S. Pat. No. 3,539,972—Ruete et al., entitled "Electrical Connector for High Voltage Electrical Systems", which issued Nov. 10, 1970 and is assigned to Amerace-ESNA Corporation. One disadvantage inherent in such prior art gas flow control mechanisms is that they do not provide a means for sealing the outermost end of the module to prevent ionized gases from escaping past it into the air surrounding the module. Accordingly, it is possible for a substantial volume of ionized gas to escape from such a loadbreak module when a separable conductor is withdrawn from the module. The ionized gases simply follow the path of the separable conductor out of the loadbreak module.

After recognizing the foregoing disadvantage of the pressure-responsive valve, auxiliary gas expansion chamber type of cable termination modules, an improved type of gas-trap valve was developed for high voltage conductor termination modules. This improved gas-trap valve mechanism was designed to retain substantially all of the arc-generated gases within a loadbreak termination module following a loadbreaking operation. One form of this improved type of gas-trap valve is disclosed in co-pending U.S. Pat. application No. 160,798 filed on July 8, 1971 (General Electric Company which was mailed to the U.S. Patent Office on July 7, 1971), entitled "Electric Cable Termination Module Having a Gas-Trap Valve". That application is assigned to General Electric Co. The gas-trap valve mechanism disclosed in that co-pending application is also described in detail below, since the present invention is ideally suited for use in combination with such a gas-trap valve.

It has been found that the arc-generated gases developed by loadbreak operations in cable termination modules designed for use on 25 KV systems develops extremely high gas pressures very rapidly. These high gas pressures, coupled with the presence of the relatively high voltages on such systems, make it difficult to insure against possible arc restrikes, or arcs to ground, when a pair of cable termination modules on such a system are opened. This problem is traceable primarily to the fact that it is difficult to manufacture a gas-trap valve that will seal a loadbreak cable termination module rapidly enough, after a separable contact is removed from the module, to prevent the escape of some ionized gas therefrom. This problem is somewhat aggravated by the common practice of providing an arc-snuffing rod or arc follower on the separable contact of conventional cable termination modules that are adapted to cooperate with a loadbreak termination module to afford a loadbreak function. Since, during a normal loadbreak operation within such a termination module, an arc is drawn along the surface of such an arc follower for an appreciable interval of time before the arc follower is sufficiently withdrawn from the loadbreak module to enable a gas trap valve to be closed thereby sealing the module, it is possible for ionized gas to escape past the valve during this interval. In addition, even after the separable contact and its arc follower are completely withdrawn from the loadbreak module so that the gas trap valve is free to close, the moment of inertia of such valves causes an inherent time delay during which additional ionized gases can escape past the valve.

Accordingly, it is a primary object of the present invention to provide an improved gas flow restricting means for a high voltage cable termination module in order to substantially reduce the escape of ionized, arc-generated gases from the module during, and following, a loadbreak operation within the module.

Another object of the invention is to provide a gas flow restricting valve means for a loadbreak cable termination module which is operable to cool ionized gases, thereby to increase the dielectric strength of such gases prior to their emission from the module.

Yet another object of the invention is to provide a low-friction gas restricting valve means for a pair of separable connectors of the rod-and-bore type, in order to prevent the escape of ionized, arc-generated gases between the rod and bore contacts during and following an arc-interrupting separation thereof.

Additional objects and advantages of the invention will become apparent to those skilled in the art from the description of it that is given herein, taken in conjunction with the accompanying drawings.

SUMMARY OF THE INVENTION

In one preferred embodiment of the invention, a loadbreak cable termination module is provided with a pivotally mounted gas trap valve adjacent its outermost end. In combination therewith, a plurality of gas flow restricting valves are provided. These flow restricting valves are operable to retain substantially all of the arc-generated gases within the termination module, following a loadbreak operation. In addition, the gas flow restricting valves are operable to cool and deionize gases that escape from the module, past the gastrap valve. In one form of the invention the gas flow restricting valve comprises a plurality of turbulence valve means; whereas, in another embodiment of the invention the gas restricting valve means comprises a plurality of "O" sealing rings that are mounted to cooperate with the bore contact and an arc follower rod associated with it to form a virtually gastight seal at the outermost end of the loadbreak cable termination module. This seal is immediately adjacent the gas-trap valve so that any escape of gas between the rod and bore contacts is substantially eliminated prior to the time that the gas-trap valve is closed.

PREFERRED EMBODIMENTS OF THE INVENTION

Figure 1:
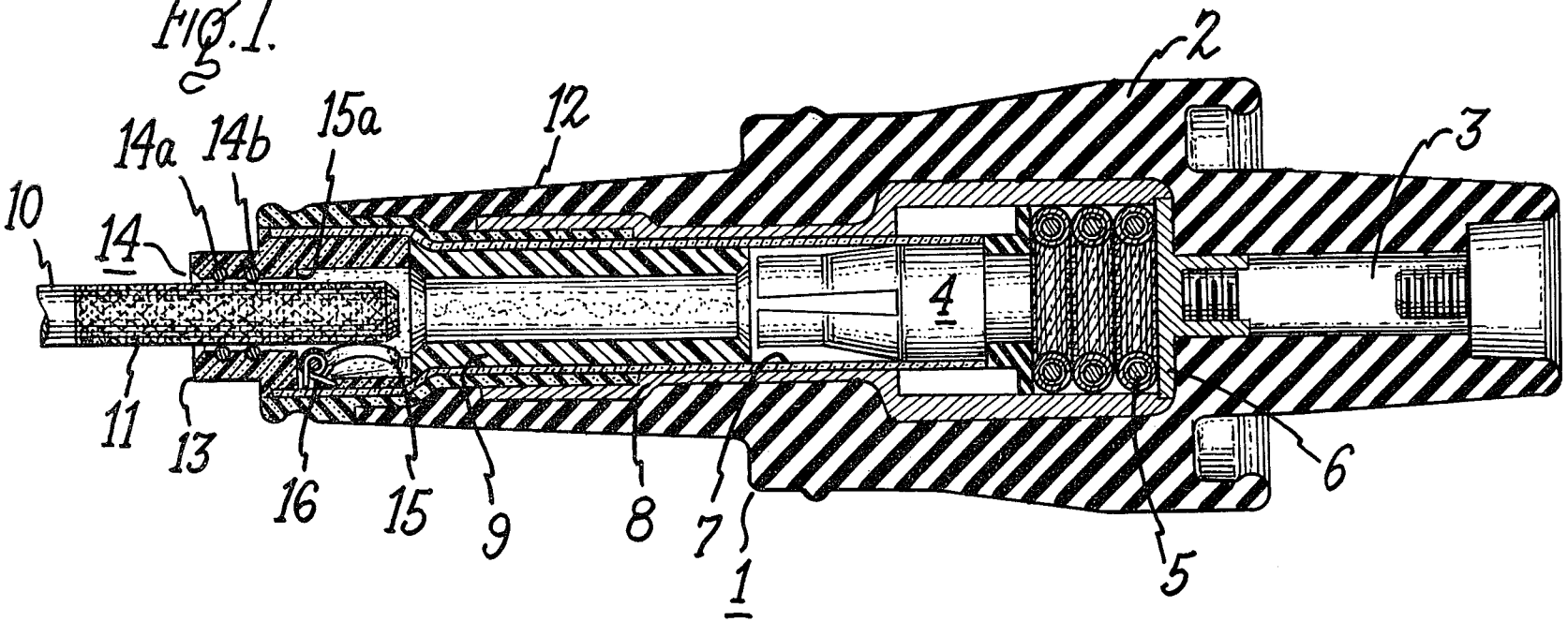
FIG. 1 is a side elevation view, in cross section, showing an electric power conductor termination module of the loadbreak type which is provided with a gas-trap valve and a gas-restricting valve that is constructed pursuant to the present invention; illustrated with respect to a movable contact and its arc follower. The movable contact is adapted to be closed against the contact in the valve carrying module to complete a circuit therewith.

Referring now to FIG. 1 of the drawing, it will be seen that there is shown a loadbreak cable termination module 1 in the form of an insert bushing that is adapted to cooperate with a second bushing module to be supported in operating position by it. It will become apparent from the following description that the invention may be housed in various types of conductor termination modules; therefore, the general configuration of such a module, e.g., module 1, is not an important factor in understanding or applying the invention. An example of a suitable cooperating bushing module, with which the module 1 may be supported, is illustrated and described in U.S. Pat. No. 3,551,587—Propst, which issued Dec. 29, 1970 and is assigned to the assignee of the present invention. It is only necessary to an understanding of the invention described herein to recognize that the termination module 1 includes an elongated insulating housing 2 that may be formed of any conventional moldable insulating epoxy material. A threaded conductor 3 is mounted at one end of the housing 2 and is in electrically conducting relationship with a reciprocally movable contact 4, through a flexible coiled conductor 5 that forms a circuit between a terminal 6 and the movable contact 4. The movable contact 4 is mounted in fixed relationship with respect to a hollow cylindrically-shaped insulating tube 7 that is adapted to move in relationship to an aluminum cylinder 8 to provide a load-break operation in a manner that is generally known in the prior art. If a more detailed description of such a reciprocally operable loadbreak type cable termination module is desired, a description of such a mechanism is given in U.S. Pat. No. 3,542,986—Kotski, which issued Nov. 24, 1970 and is assigned to the assignee of the present invention.

Also mounted on the interior surface of insulating cylinder 7 is a cylinder of arc-extinguishing, gas-evolving material 9, which may be formed of a suitably stable polyoxymethylene, nylon or a suitable cycloaliphatic resin. One example of such a suitable resin is disclosed in U.S. Pat. No. 3,586,802—Nichols et al, which issued June 22, 1971 and is assigned to General Electric Company.

As shown in FIG. 1, a second movable contact 10, having an arc snuffer 11 formed of gas-evolving material, which may be similar to that of the material in cylinder 9, is positioned for insertion into engagement with the movable contact 4 to complete an electrical circuit between the contacts 4 and 10. Such a circuit is shown, for example, in the assembled position of the relatively separable electric cable conductor termination modules illustrated in the above-mentioned Propst patent. As is well known, the contact 10 is normally supported in a second cable termination module that includes an elongated insulating housing having a voltage-grading sealing surface that is adapted to cooperate with the frusto-conical surface 12 of module 1 to form a water-tight seal therewith when the contacts 4 and 10 are moved together to complete a circuit.

Pursuant to the present invention, an insulating wall member 13 in the form of a generally cylindrically shaped tube is rigidly mounted in the outer end of the reciprocal insulating cylinder 7. Thus, it can be seen that the insulating member 13, the arc-extinguishing cylinder 9, and the inner portion of insulating cylinder 7 constitute, in combination, means defining a contact-receiving passageway that extends from a first end of the elongated housing 2 of module 1 a predetermined distance into the housing. More specifically, this passageway continues through slots in the resilient finger-like contactors of movable contact 4 to the inner surface of terminal 6. As is shown in FIG. 1, the electrical contact 4 is mounted in this passageway substantially concentrically so that it is positioned to be engaged by the second contact 10 that is adapted to be movable into the passageway.

A gas-restricting valve means 14 is mounted on wall member 13 adjacent the outermost end of the passageway that is partially defined by member 13. In this embodiment of the invention, the valve means 14 comprises a pair of resilient sealing rings **14*a*' and 14*b*' (also shown in FIG. 2), which are respectively mounted in a pair of generally circular grooves 14*a*' and 14*b*' in the wall member 13. It will be understood that any suitable wall means defining the grooves 14*a*' and 14*b*' may be employed in various embodiments of the invention. However, it is desirable that each of the grooves 14*a*' and 14*b*' are positioned so that planes through their respective circumferences are substantially parallel to one another. The grooves 14*a*' and 14*b*' are thus positioned to surround the arc-follower member 11, and contact 10, when they are moved past the grooves into the passageway defined in part by the insulating wall member 13. Therefore, the resilient O-rings 14*a* and 14*b*, which are circular in cross-section, cooperate with the rod-like arc follower 11 and contact 10 to form a substantially gas-tight seal that prevents arc-generated gases formed in the passageway of module 1** from escaping from the module.

Before proceeding further with a description of the gas-restricting valve means of the present invention, it should be noted that a pivotally mounted gas-trap valve 15 is supported within the insulating wall member 13 and is spring-biased by a coiled spring 16 to close against a valve seat **15*a* and thereby substantially seal the passageway in module 1 after the arc follower rod 11, which may be regarded as part of the contact member 10–11, has been withdrawn from this passageway. The operation of this type of gas-trap valve is readily understandable, because it constitutes a simple spring-biased, pivotally mounted member, the position of which is controlled by its engagement with the movable arc follower rod 11 and contact 10**. However, if a further description of such a gas trap valve is desired, reference may be made to the above-identified copending Kotski patent application.

In order to fully understand the operation of the invention described herein, it is desirable to recognize that when contact 10 is moved out of engagement with contact 4, an arc will normally be drawn between these two contacts if the circuit to which they are coupled is energized. Such an arc will engage the gas-evolving materials of arc follower 11 and cylinder 9. Thus, a large volume of high pressure gas will be quickly developed within the passageway in module 1. Since the gas-trap valve 15 cannot be closed until the arc follower rod 11 has been completely moved past it, such high pressure gas might escape between the bore of the passageway in module 1 and the rod of contact 10, and rod-like arc follower 11, if some means were not provided to restrict the passage of gas from the module 1. As pointed out above, in the preferred embodiment of the invention described in FIG. 1, the resilient "O" sealing rings **14*a* and 14*b* operate to restrict gas from escaping from the module 1 until gas-trap valve 15 is closed. An additional feature of this embodiment of the invention is that it causes any gas that might possibly move past the gas-restricting valve means 14 to be forced into considerable turbulence, which serves to cool and thus deionize the gas so that it is less likely to cause an arc re-strike between the contacts 4 and 10, or to cause an arc to be formed between the contact 10** and a ground-potential surface adjacent to it.

It should be understood that although a pair of resilient sealing rings **14*a* and 14*b* are shown in the preferred embodiment of the invention, a single "O" ring positioned in at least one groove, such as groove 14*a*', may form a suitable gas-restricting valve for some applications of the invention. Now, reference will be made to FIG. 3 which illustrates a second embodiment of the invention. In FIG. 3, the identifying numbers used are the same as the numbers used in FIGS. 1 and 2, where identical parts are being designated. Thus, there is shown a portion of a cable conductor termination module 1 that includes an elongated housing 2 having a reciprocally mounted insulating cylinder 7 positioned therein. The cylinder 7 supports a tube of arc-extinguishing insulating material 9 and an insulating wall member 13'. The insulating wall member 13' supports a spring-operated gas-trap valve 15. A second movable contact 10 of a second conductor termination module is positioned for movement into the passageway defined by wall member 13' and arc-extinguishing tube 9. The second contact 10 supports a rod-like insulating arc follower 11** on its outermost end.

Pursuant to this second embodiment of the invention, the wall member 13' includes wall means defining a plurality of generally circular grooves 17 and 18 therein. Each of these grooves 17 and 18 is positioned so that planes through their respective circumferences are substantially parallel to one another. Also, the wall means defining each of the grooves 17–18 comprises two planar side walls **17*a*, 17*c*, and a cylindrical bottom wall 17*b* groove 17. This angular configuration of the groove 17 serves to enhance the gas restricting action of the gas restricting valve means 14' of this embodiment of the invention, because it serves to induce substantial turbulence into any high pressure gas flowing between the arc follower member 11 and the insulating wall member 13'. Thus, the grooves 17 and 18 operate as a turbulence valve means 14' to substantially restrict the escape of gases from the passageway defined in the module 1. Also, the turbulence valve means 14' serves to significantly cool and thus deionize any gases moving through it to the exterior of the module 1**.

Figure 4:
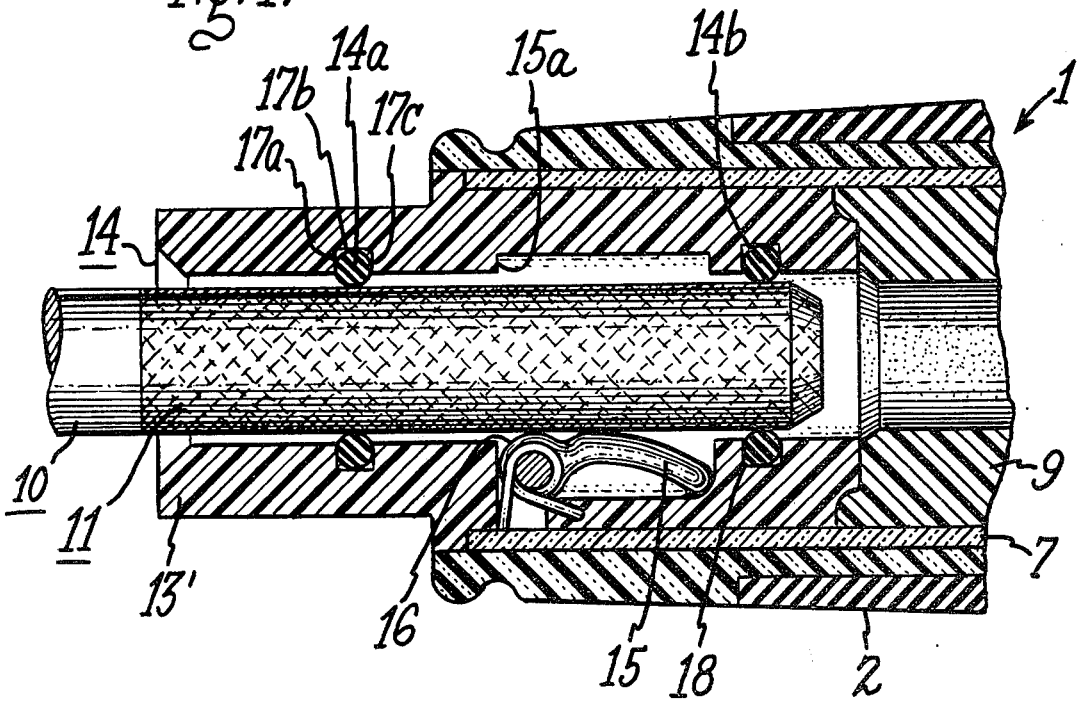
FIG. 4 is a fragmentary, side, elevation view, partly in cross section, illustrating a loadbreak termination module similar to that depicted in FIG. 1 but including another alternative embodiment of the gas-restrictive means of the present invention.

In this second embodiment of the invention, the gas-trap valve means 15 is shown mounted inside of both of the grooves 17 and 18. However, it should be understood that in other embodiments of the invention it may be desirable to position gas restricting valve means 14' (or 14) such that the gas-trap valve 15 is located between a pair of gas-restricting valve grooves 17 and 18. Such an embodiment is shown in the FIG. 4 of the drawings.

It should be apparent that the embodiment of the invention illustrated in FIG. 3 may also be modified by mounting resilient O-rings, such as the O-rings **14*a* and 14*b* of the embodiment of the invention described above with reference to FIGS. 1 and 2, within the grooves 17 and 18. In such a modification, it is only important to assure that each of the grooves 17 and 18 is shallower than the diameter of the generally circular O-rings mounted therein, so that a portion of each of the rings extends beyond the innermost circumference of the grooves, into gas-restricting contact with the arc follower rod 11**.

Figure 2:
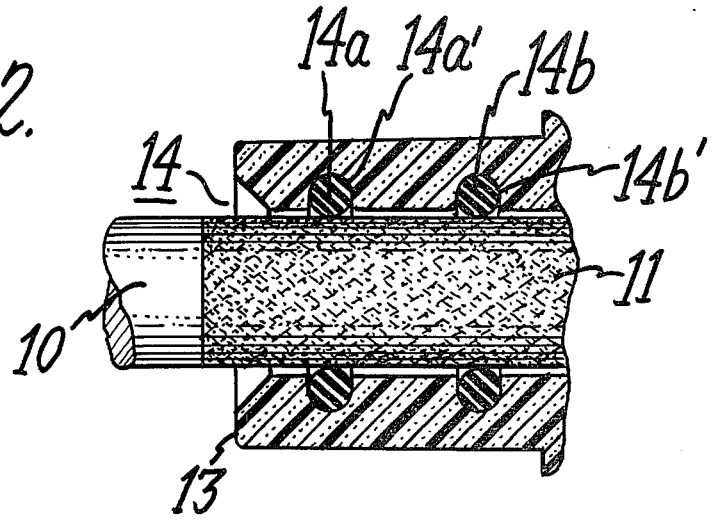
FIG. 2 is a fragmentary side elevation view, partly in cross section, illustrating a portion of a loadbreak termination module like the module depicted in FIG. 1, and showing in enlarged detail one form of the gas-restricting valve of the present invention.
Figure 3:
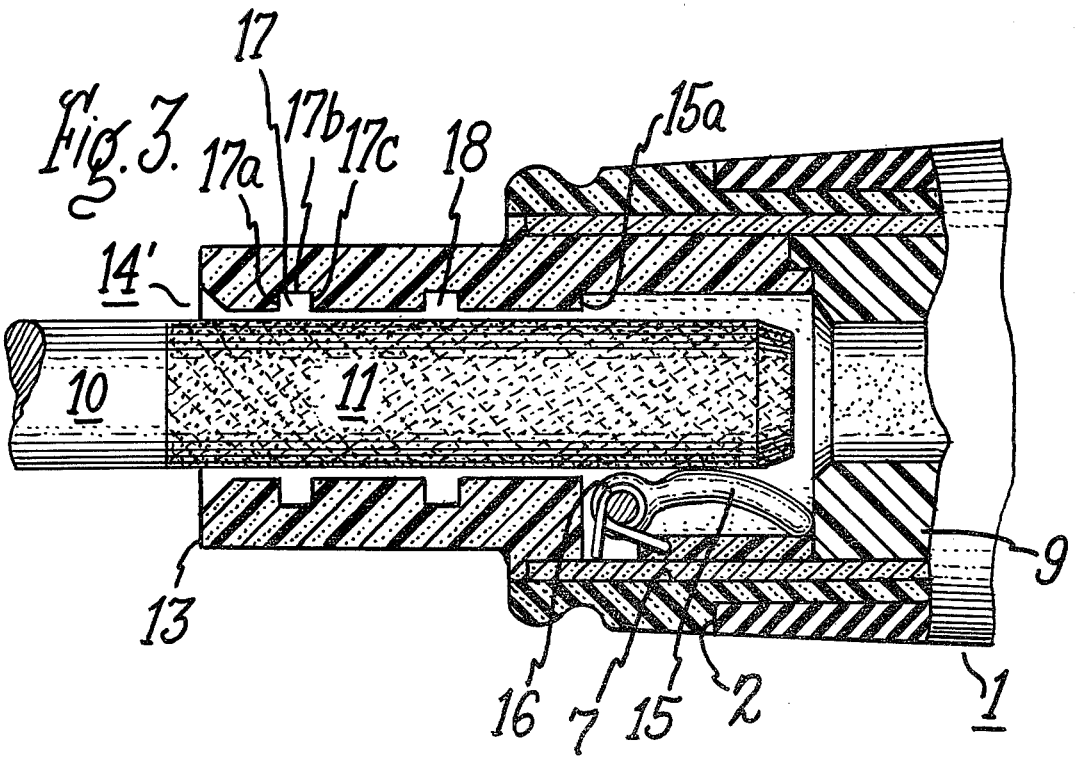
FIG. 3 is a fragmentary side elevation view, partly in cross section, illustrating a loadbreak termination module similar to that depicted in FIG. 1, but including an alternative embodiment of the gas-restricting valve means of the present invention. This valve means is also shown with respect to a separable contact and an arc follower mounted on that contact.

It will be noted that in the embodiment of the invention shown in FIGS. 1 and 2, the generally circular grooves **14*a*' and 14*b*' include a surface that substantially complements at least half of the surface of the sealing rings, 14*a* and 14*b* respectively, mounted therein. This preferred embodiment assures a tighter gas-seal and more positive locking action of the O-rings than the modified form suggested above, wherein the O-rings would be mounted in generally rectangular or square slots 17 and 18. Also, in the preferred embodiment of the invention the resilient sealing rings 14*a* and 14*b*** are formed of insulating material. It has been found that rubber O-rings are suitable for this insulating material. A particularly durable, abrasion-resistant O-ring of this type is a fluoroelastomer material currently manufactured and sold under the DuPont trade name VITON, by the Parker Seal Company of Culver City, Calif.

The operation of the gas-restricting valve means 14 and 14' of the preferred embodiments of the invention described above are believed to be apparent to those skilled in the art from that description. Accordingly, a further discussion of the operation will not be given herein. It should only be noted that whereas the gas restricting valve means 14 or 14' are believed to be ideally suited for use in combination with a gas-trap valve, such as valve 15 described above, such a combination is not an essential feature of the basic gas-restricting valve means of the present invention.

Those skilled in the art will understand that various improvements and modifications of the present invention may be made based on the description of it that is presented herein . Accordingly, it is our intention to encompass within the scope of the following claims the true spirit and intent of the invention so that all such obvious modifications and improvements are encompassed within the claims.

An example of such a modification of the preferred embodiment of the invention disclosed above would be to make the inner walls of wall member 13 (or 13') generally smooth, while forming a plurality of circular grooves in the rod-like insulating material 11 or in contact 10, thereby to form a gas-restricting turbulence valve. Of course, resilient O-rings could be mounted in the grooves thus formed on contact member 10–11, in a manner suggested by the teaching of the second embodiment of the invention described above.

What we claim as new and desire to secure by Letters Patent of the United States is:

1. A separable connector module for shielded electrical power cable, the module being of the type having:

(a) an insulating housing;

(b) a passageway extending into said housing, said passageway including a sleeve of gas-evolving material inside the passageway, said gas-evolving material evolving arc-extinguishing gas when subjected to electrical arcing inside said passageway;

(c) a first metal contact member in said passageway and near the inner end of said sleeve, the gas-evolving inner surface of said sleeve being exposed between said first contact and the entrance of said passageway, wherein the improvement comprises, a resilient gasket around the inner wall and adjacent the entrance of said passageway for restricting the escape of arc-generated gases from said passageway when a second contact member is partly inserted in said passageway and electrical arcing is established between said first and second contact members.

2. The connector of claim 1 wherein said gasket comprises at least one "O" ring situated in a groove about the inside perimeter of said passageway and adjacent the entrance.

3. The connector of claim 1 and comprising a gas-restricting valve in said passageway, said valve being open when said second contact member is inserted in said passageway and being otherwise closed against rapid flow of gas through said passageway toward its entrance.

4. The connector of claim 3 and wherein said gasket comprises at least one "O" ring situated in a groove about the inside perimeter of said passageway and adjacent the entrance.

5. The connector of claim 1 and comprising a gas expansion chamber communicating with said passageway.

6. A high voltage load break plug for a bushing having an electrically conductive contact and an arc extinguishing sleeve on the end of the contact, said plug having an electrically conductive probe and an arc extinguishing follower on the end of the probe, the improvement comprising:

a resilient seal ring mounted on the follower and having an outer diameter equal to or greater than the inner diameter of the sleeve to sealingly engage the sleeve, said seal ring being located at the end of the follower remote from the probe so that the products of decomposition produced upon interruption are confined in the space between the follower and the sleeve and within the bushing.

7. The plug according to claim 6 wherein said seal ring comprises a first O-ring seal on the end of the follower.

8. A high voltage load break bushing for a plug having an electrically conductive probe and an arc-extinguishing follower on the end of the probe, the bushing having an electrically conductive contact and an arc-extinguishing sleeve on the end of the contact, the improvement comprising, a resilient seal ring mounted within and adjacent to the open end of said sleeve to sealingly engage said follower upon interruption and having an inner diameter equal to or smaller than the outer diameter of the follower to confine the gases produced by the heat of the arc upon interruption in the space within the bushing.

9. The bushing according to claim 8 wherein said seal ring comprises an elastomeric cylindrical sleeve on the inner surface of said sleeve.

10. The bushing according to claim 8 wherein said seal ring comprises an elastomeric material covering the inner surface of said sleeve.

11. The bushing according to claim 8 wherein said seal ring comprises an O-ring.

12. Electric connector apparatus comprising a tubular contact pin, a tubular contact socket of conducting material having at least one open end arranged to cooperate with said contact pin, and a hollow tubular quench tube disposed at said one end of said contact socket and arranged in substantially aligned coaxial relation therewith so as to accommodate telescopic movement of said contact pin relative to said contact socket and quench tube, said tube being of composite construction and including an inner sleeve of arc extinguishing insulating material and an outer sleeve of mechanically strong plastic material.

13. Apparatus according to claim 12 wherein at least one groove is formed about the inner periphery of said quench tube and wherein a resilient grommet is seated within said groove for guiding said contact pin and for sealing said tube.

14. Apparatus according to claim 13 wherein a plurality of axially spaced grooves are formed about the inner periphery of said quench tube and wherein a plurality of resilient grommets are sealed within said grooves respectively, the inner peripheries of said grommets being configured to accommodate axial movement of said pin through said tube.

* * * * *